US006631589B1

(12) United States Patent
Friedman et al.

(10) Patent No.: US 6,631,589 B1
(45) Date of Patent: Oct. 14, 2003

(54) ELEVATOR WALL PANEL MOUNTING STRUCTURES AND METHOD OF INSTALLATION FOR CAB INTERIOR

(76) Inventors: Harold Friedman, 7 Gracie Sq., New York, NY (US) 10028; Michael Mlodynia, 135 Ketay Dr. S., East Northfort, NY (US) 11731; Angelo Palmieri, 2445 Matthews Av., Bronx, NY (US) 10467; Scott Broders, 149 Tanya Ln, Ocean, NJ (US) 07712

( * ) Notice: Subject to any disclaimer, the term of this patent is extended or adjusted under 35 U.S.C. 154(b) by 0 days.

(21) Appl. No.: 09/518,128

(22) Filed: Mar. 3, 2000

(51) Int. Cl.[7] ..... E04H 6/06

(52) U.S. Cl. ..... 52/30; 52/281; 52/283; 52/506.05; 52/506.09; 187/401

(58) Field of Search ..... 52/506.1, 506.06, 52/506.08, 506.09, 469.1, 235, 289, 261, 264, 266, 263, 281, 283, 506.05; 187/401, 414

(56) References Cited

U.S. PATENT DOCUMENTS 3,621,635 A * 11/1971 De Lange
3,631,942 A * 1/1972 Brounn ..... 52/476
4,292,779 A * 10/1981 Landheer ..... 52/486
4,357,993 A * 11/1982 Halpern et al. ..... 187/1 R
4,430,835 A * 2/1984 Ericson ..... 52/282
4,462,193 A * 7/1984 Ericson ..... 52/282
4,635,756 A * 1/1987 Sherwood et al. ..... 187/1 R
4,708,222 A * 11/1987 Bills et al. ..... 187/1 R
4,875,552 A * 10/1989 Smith et al. ..... 187/1 R
5,953,876 A * 9/1999 Agar ..... 52/489.1
6,209,686 B1 * 4/2001 Tomasetti et al. ..... 187/401

* cited by examiner

*Primary Examiner*—Carl D. Friedman
*Assistant Examiner*—Yvonne M. Horton

(57) ABSTRACT

The present invention provides a method and structure for decorating the interior of elevator cab walls by even unskilled personnel, without wastage of time, and of sufficient modularity so as to be adaptable for retrofitting on existing elevator cab walls and accommodating existing constraints of space, dimension and weight. In a preferred embodiment, a plurality of horizontal and vertical members are joined together to form an advantageous lattice frame structure for supporting decorative panels. The horizontal members incorporate downward facing elongated hanger slots for removable engagement with upwardly facing elongated finger members that are affixed to the interior wall surface of the elevator cab. Swing arrester members are affixed to the cab wall and are engagable with the vertical member to inhibit lateral motion of the lattice frame structure. The lattice frame is made of lightweight extruded aluminum members of the same cross section.

3 Claims, 5 Drawing Sheets

ELEVATOR WALL PANEL MOUNTING STRUCTURES AND METHOD OF INSTALLATION FOR CAB INTERIOR

FIELD OF INVENTION

The present invention relates to readily removable and easily installable wall panel mounting structures and method of installation for the interior of elevator cabs and in particular to an advantageous lattice frame mounting structure and method for installation for removable decorative panels for shell walls interior of elevator cab enclosures.

BACKGROUND OF THE INVENTION

Aesthetic and architecturally appropriate elevator cab walls have become a prerequisite for quality elevators. The industry continues to struggle with projects involving the most effective renovation or new construction of decorative wall panels for the interior walls of elevators. In both renovation and new construction elevators are used for the transport of construction material to the higher floors which subjects the cab interior walls to damage, resulting in additional costs and expenditure of time for repairs. Accordingly, it is lightly desirable to have decorative panels for mounting on the shell walls of elevators that are readily installed and removed when desired with a minimum of effort and expense.

Elevators are frequently re-modeled rather than replaced when a building is remodeled or upgraded. There are constraints on the net amount of weight for cab wall panels that can be added. In addition, the dimensions and wall thickness of elevator cabs are subject to design constraints. Consequently, there is a need for decorative interior wall finishes to be lightweight and of minimum thickness while at the same time being sturdy and easy to install and remove.

Hitherto, varieties of systems have been devised to embellish and decorate the interior of elevator cab walls. One system and structure as disclosed in U.S. Pat. No. 4,875,552 is a decor lamination 120 disposed on the inner face of the panels that constitute the elevator cab wall. The panels 22 & 24 are held in place by anchors 36 and clips 60.

Another system as disclosed in U.S. Pat. No. 3,631,942 entails the use of removable wall panels. The panels are mounted on the elevator walls. Spring means are used to hold the wall panel in place.

Other prior art panels have the following advantages and disadvantages:

1. Non removable panels (applied panels are fastened directly to the cab shell in the factory)

Advantages

1. Maximizes elevator cab interior size
2. Panels are securely fastened

Disadvantages

1. Panels cannot be removed and reinstalled if any kind of damage occurs or cosmetic changes are desired
2. Entire walls are shipped with panels already attached, making installation in field very difficult due to bulk of assembly 2. Removable panels mounted on a plywood substrate Advantages 1. Panels can be removed in the field for restoration or replacement Disadvantages 1. Added weight to the elevator cab due to the extra weight of the plywood
2. Decreased interior elevator cab size due to the added thickness of the plywood
3. Installation and removal of interior panels is difficult due to the increase in material weight 3. Removable panels mounted on ⅛" sheet of aluminum Advantage (compared to plywood substrate)

1. Less weight added to the elevator cab than wood
2. Increases elevator cab interior size
3. Installation and removal of interior panels is not as difficult due to the decrease in weight Disadvantages 1. Because the aluminum is not as rigid as plywood, the interior panels have a tendency to bend or wrap making the panels difficult to handle
2. Special handling in packaging and shipping due to lack of rigidity None of the known methods and structures achieves the desired modularity, saving of time and expense, and the aptness to be retrofitted of the present improvement described below. What is needed, therefore, is a structure and method for embellishing elevator cab wall interiors that is easily adaptable to the variance in elevator cab sizes, which are sturdy and lightweight and can be fitted easily and without wastage of time and expense on new and existing elevator cabs.

SUMMARY OF THE INVENTION

The present invention is on improvement in mounting removable decorative elevator wall panels by means of an extruded aluminum lattice frame structure on to the shell wall of an elevator cab and provides following advantages:

1. Sound deadening material may be inserted in the space created by the lattice frame
2. The space created by the lattice frame with channel shaped members creates a new type of cab venting system which will allow the air from the elevator shaft to be brought in through the top of the cab down behind the cab panel in out the base area
3. A hidden panel-locking device
4. Decorative panels can be assembled into the substructure in the factory without the need for a chemical based adhesive Additional advantages of the installation method of this invention:

1. The field installation of wall panels on the shell walls of an elevator cab can be handled by non-specialized workers. Decorative pannels can be placed on the shell walls of the cab after major construction has been completed. The decorative panels may be easily removed to prevent damage during renovation. Carpenters and handymen will now be able to install cab wall panels. This will decrease the rate paid for installation, on top of the time savings
2. For new construction, manufacture of the car shell walls can be separated from fabrication of the interior panels. Sophisticated interior designs can be installed after completion of the elevator cab with shell walls An object of the present invention is to provide a improved method and structure for embellishing and decorating elevator cab wall interiors.

Another object of the present invention is to provide a lightweight yet sturdy structure for embellishing the interior of elevator cab walls.

Yet another object of the present invention is to provide a method and apparatus that is modular and has retrofitting applicability for purposes of embellishing elevator cab walls.

Yet another object of the present invention is to provide a method and structure for embellishing elevator cab walls without wastage of time or expense.

Yet another object of the present invention is to provide structure and method for embellishing the interior of elevator cab walls which minimizes the space used and maximizes the internal usable area.

The present invention provides a method and structure for decorating the interior of elevator cab walls by even unskilled personnel, without wastage of time, and of sufficient modularity so as to be adaptable for retrofitting on existing elevator cab walls and accommodating existing constraints of space, dimension and weight.

In a preferred embodiment, a plurality of horizontal and vertical members are joined together to form an advantageous lattice frame structure for supporting decorative panels. The horizontal members incorporate downward facing elongated hanger slots for removable engagement with upwardly facing elongated finger members that are affixed to the interior wall surface of the elevator cab. Swing arrester members are affixed to the cab wall and are engagable with the vertical member to inhibit lateral motion of the lattice frame structure. The lattice frame is made of lightweight extruded aluminum members of the same cross section.

DETAILED DESCRIPTION OF PREFERRED EMBODIMENTS

Figure 1:
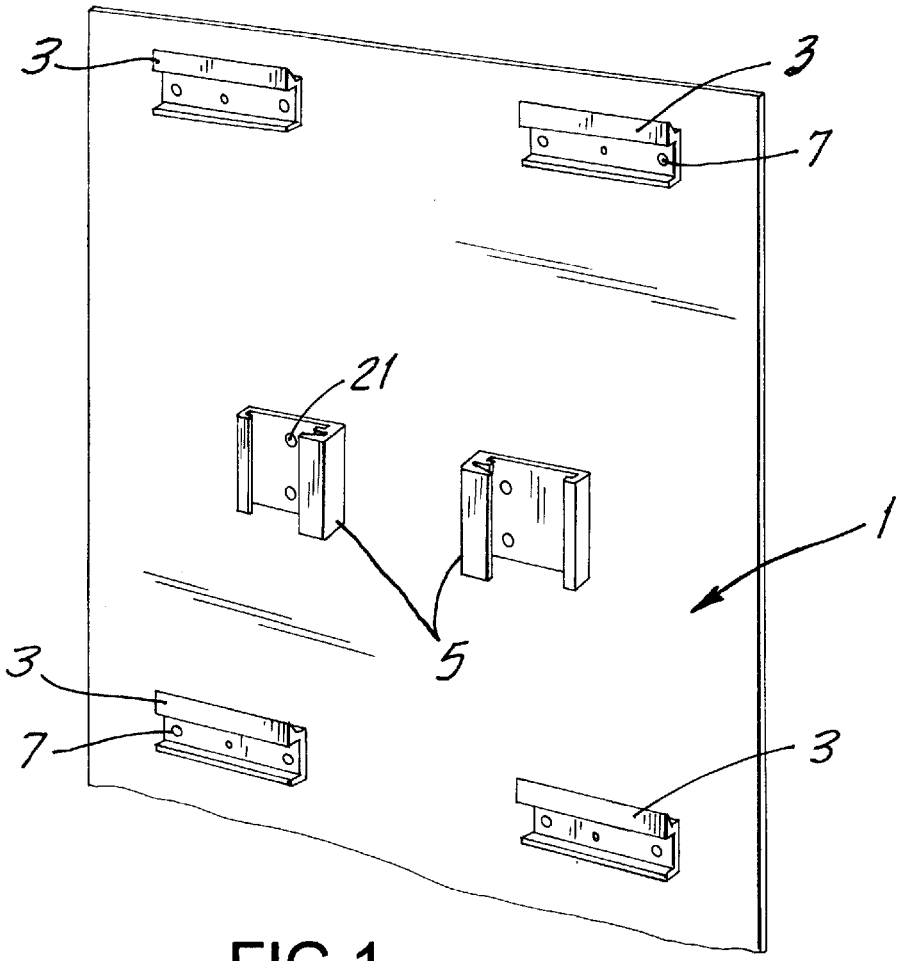
FIG. 1 is a view of horizontal hanger members and swing arrester members mounted on the shell of an elevator cab.

FIG. 1 shows the shell wall of an elevator cab fitted with hanger means for supporting a lattice frame with decorative panels. A pair of upper and lower vertical support hanger claws 3 are mounted on cab shell wall surface 1 by screws 7. Lateral swing arrester member 5 is also mounted on the cab shell wall surface 1 by screw means 21. A template may be used for accuracy the cooperating hanger means on the lattice frame. A second three piece set of two vertically aligned hanger claws and swing arrester is disposed adjacent to the first set.

Figure 2:
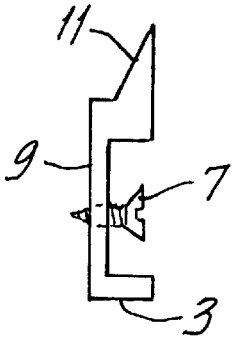
FIG. 2 is a side view of a horizontal hanger member for use in mounting a lattice frame for supporting decorative panels.

FIG. 2 shows a cross section of vertical support hanger claw 3. A finger shaped wedge portion 11 provides support and an engagement means for the hanger means on the lattice frame. Flat portion 9 incorporates apertures for affixing hanger claws 3 to cab shell wall surface 1 by screws 7.

Figure 3:
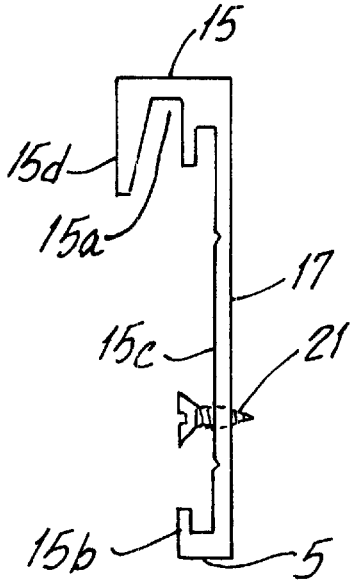
FIG. 3 is a cross sectional view of the horizontal and vertical lattice frame members and the swing arrester member.

FIG. 3 shows a cross section of the lateral swing arrester hanger members 5. Anvil portion 15 provides a channel slot 15*a* for engaging a cooperative portion of the lattice frame 33 to prevent sideways motion of the lattice frame 33. Flat affixation portion 17 provides an aperture for affixing hanger member 5 to cab wall surface 1 by screw means 21.

FIGS. 4, 5, 6 and 7 disclose the structure of an advantageous lattice frame 33 for supporting decorative panels 35 on the shell wall 1 of the elevator cab. A bridging member 31 joins horizontal member 13 and vertical member 19 in a sturdy rectangular lattice frame structure 33. Bridging member 31 consists of an arch portion 29 and shoulder portions 23 and 27 at opposite ends of the arch portion 29. The shoulder portions 23 and 27 incorporate apertures for affixing the bridge member 31 to the horizontal member 13 and vertical member 19 by screws. Other means of affixation may also be employed to advantage. Furthermore, other means such as welding or gluing may be employed to advantage in order to co-join the vertical member 19 to the horizontal member 13.

Figure 5:
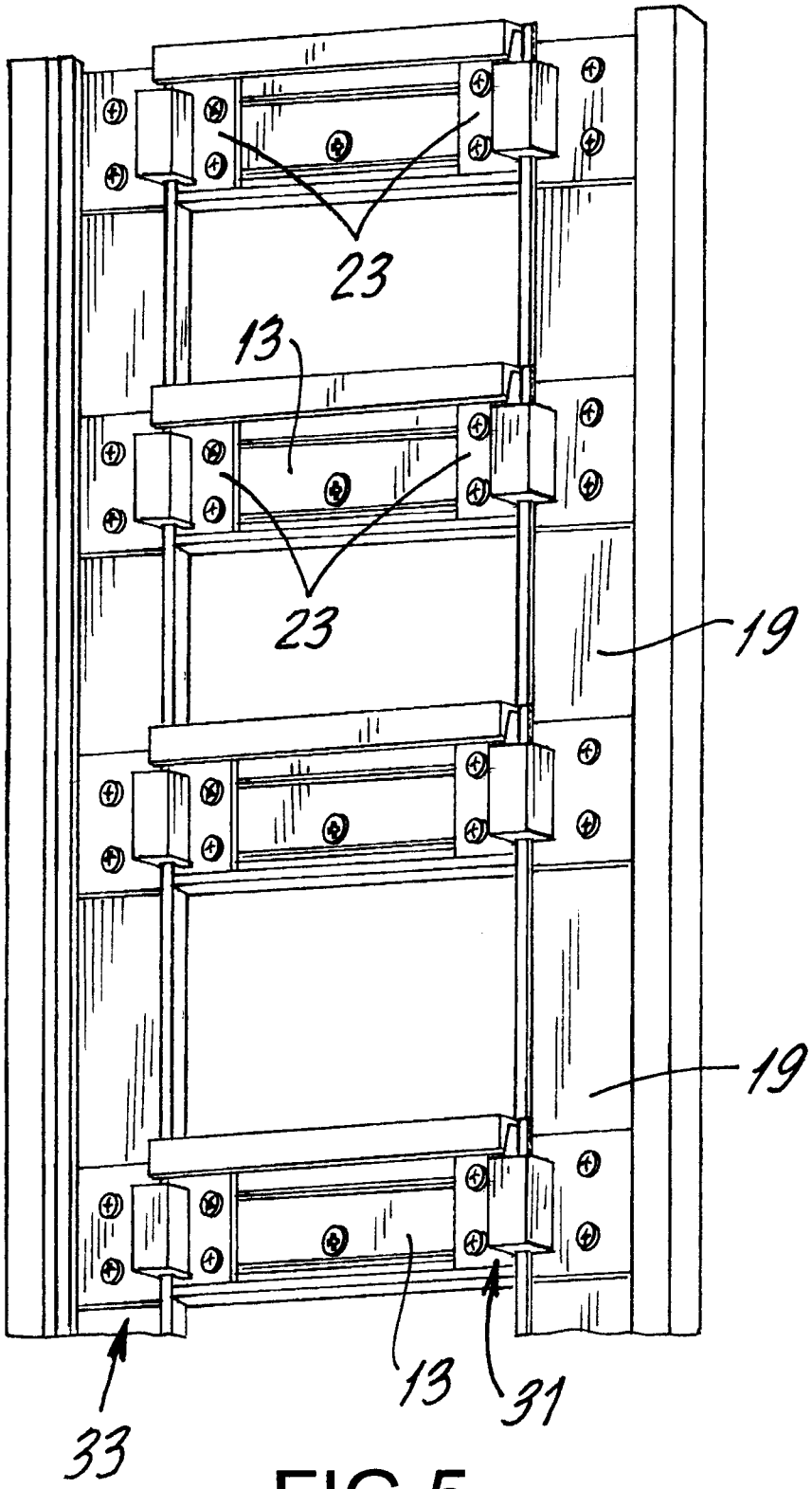
FIG. 5 is a view of one form of the advantageous lattice frame structure of this invention.
Figure 6:
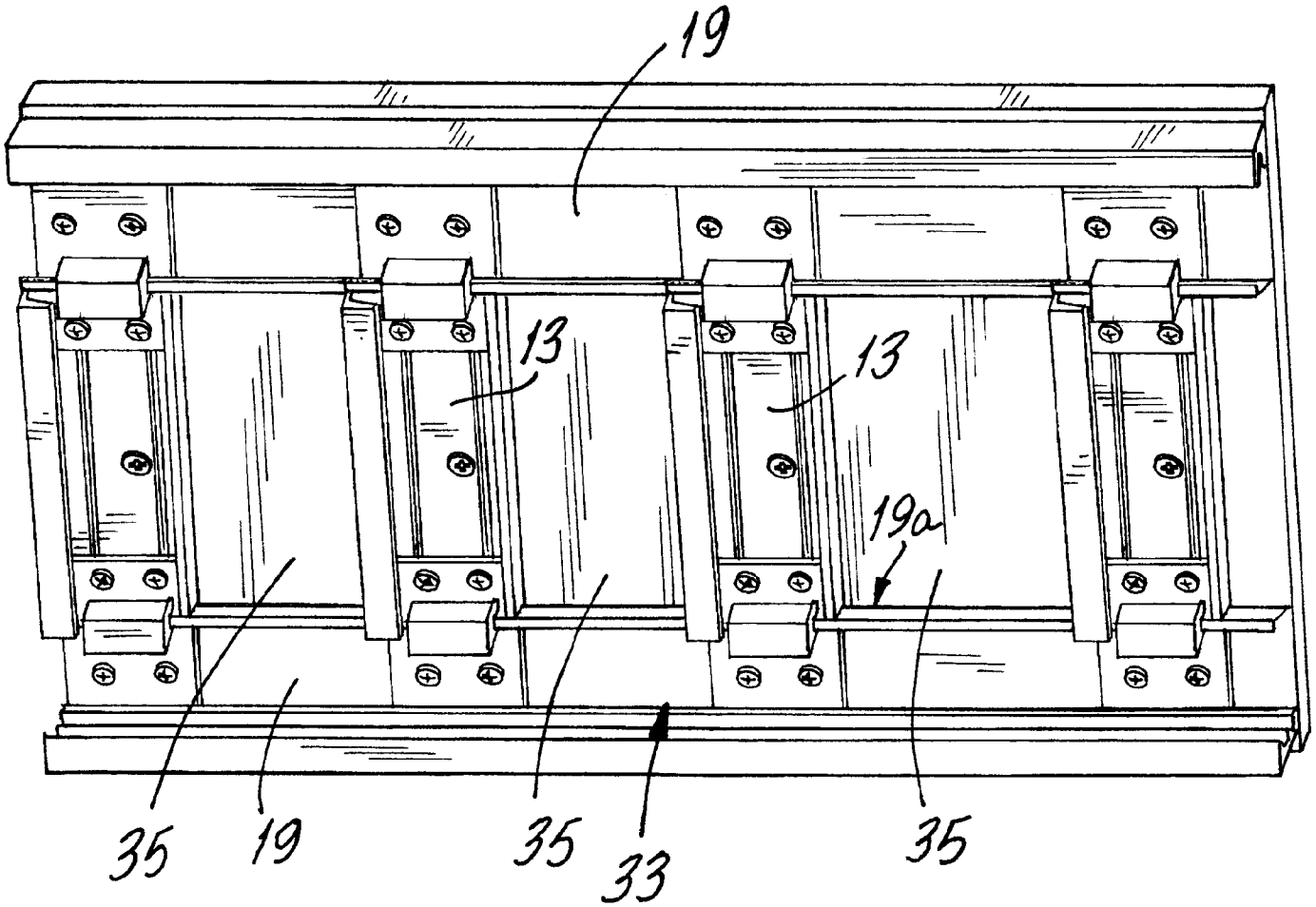
FIG. 6 is a view of back side of the decorative panels affixed to the lattice frame structure.

FIG. 5 and 6 disclose one embodiment of the lattice frame which has four (4) horizontal members 13 and two vertical members 19 forming a rectangular shape. Alternatively, the lattice frame may have only two horizontal members 13 and may be made in the form of a square. Thus, the lattice frame may be made of two vertical members and two or more horizontal or lateral members.

Figure 7:
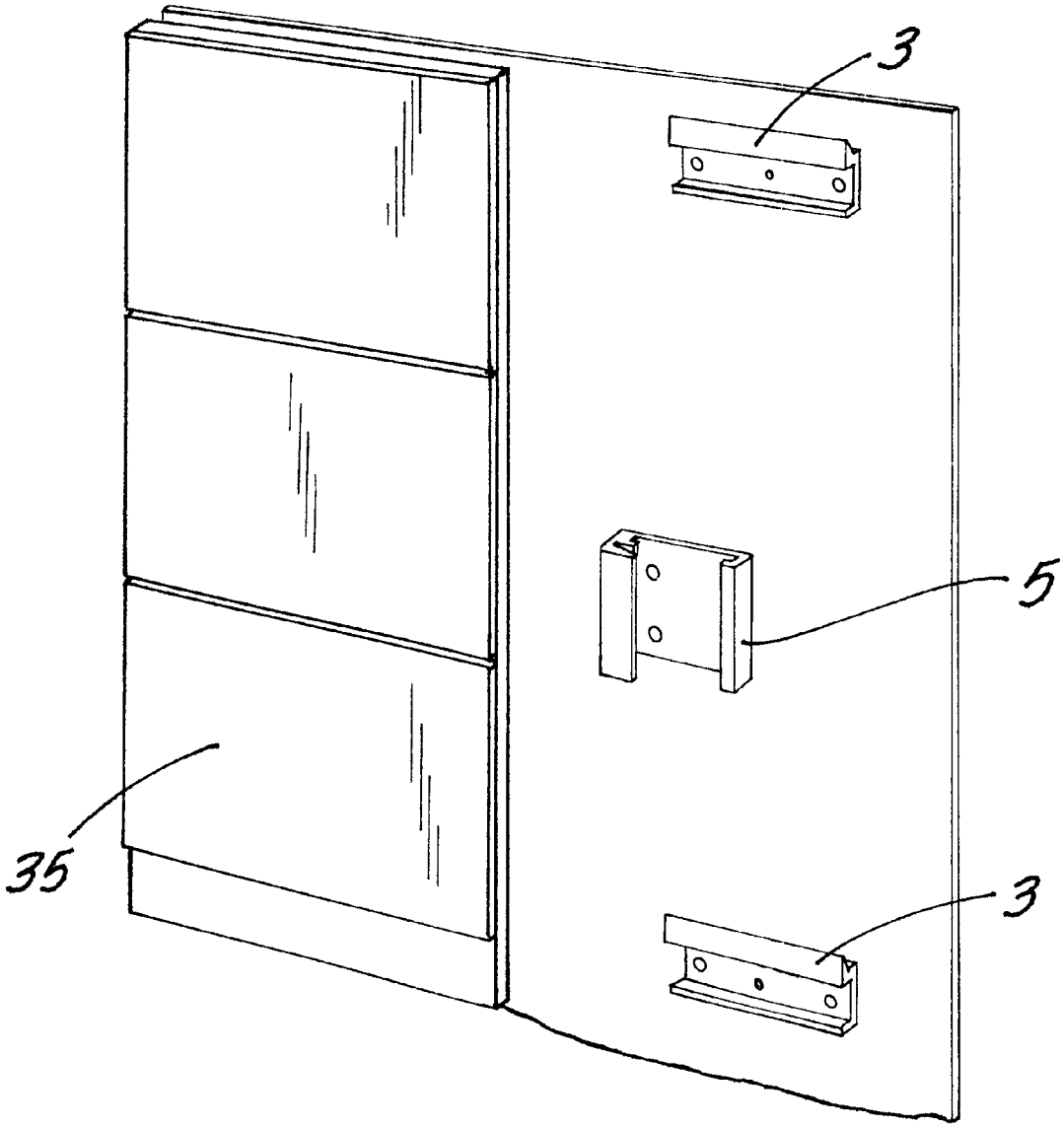
FIG. 7 is a of the front side of the decorative panel on the lattice frame structure of FIG. 6 mounted on the shell wall of an elevator cab and with hanger and swing arrester members on an adjacent surface of the shell wall ready to receive a second lattice frame with a decorative panel to be mounted adjacent to the first panel.

In FIG. 6 the lattice structure 33 is affixed to decorative panel 35. In FIG. 7 the decorative panel 35 is disposed on a cab shell wall 1 by the lattice frame and the hanger means. Another 3 piece mounting set of two claws 3 and a swing arrester 5 is mounted next to the panel 35 to receive a second decorative panel.

The lattice frame 33 is made of channel shaped extruded aluminum members. The swing arrester member 5 and both the horizontal and vertical frame member 13 and 19 have the same channel shaped extrusion cross section as shown in FIG. 3. Thus the same shape of the aluminum extrusion may be utilized to make much of the structure.

Figure 4:
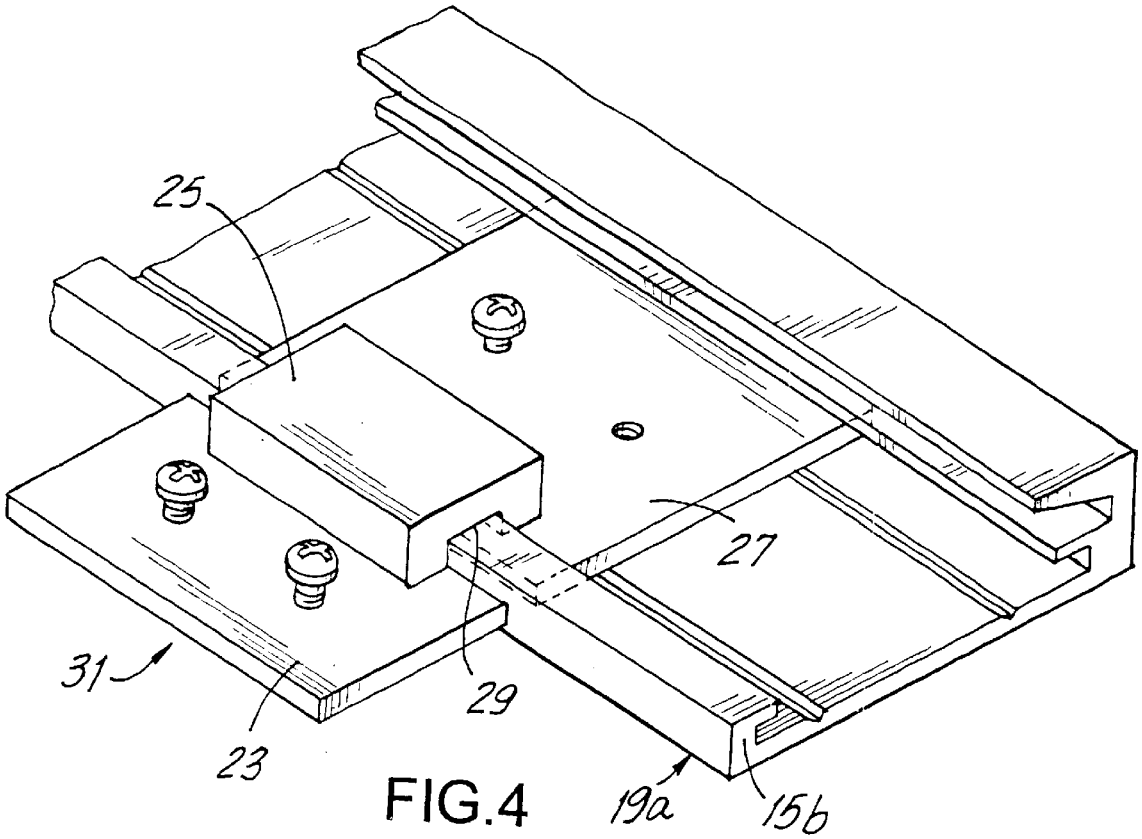
FIG. 4 is a view of the vertical lattice member and a bridging piece employed to join vertical and horizontal lattice members of the lattice frame structure.

The bridging member 31 is for crossing above the foot shoulder 15*b* of the vertical frame member 19 so that the flat shoulder portions 23 and 27 may be engaged with the flat inside surfaces of the vertical and horizontal frame members 13 and 19 as shown in FIGS. 4 and 5.

The lattice frame member may be made in a rectangular shape with 4 horizontal members 13. It may also be constructed as a square with only 2 vertical members. Alternatively, it may be made of a plurality of vertical members 13 depending on need.

Thus this invention uses an advantageous lattice frame that allows decorative panels of various shape to be easily hung on hanger means on the elevator cab shell wall. The lattice frame may be easily put in place at the desired time or removed and replaced with new panels.

Figure 4A:
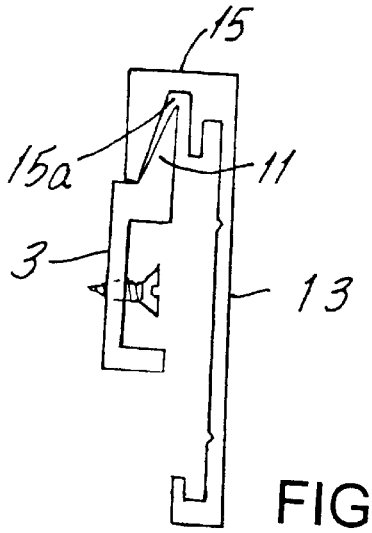
FIG. 4*a* is a cross sectional view of the horizontal lattice member shown engaged with a hanger member.

The frame may be easily slid so that the fingers 11 of claws 3 engages the slot 15*a* as shown in FIG. 4*a*. The swing arrester is positioned to engage the inside edge 19*a* of the vertical support to prevent lateral movement. The lattice frame 33 is of exceptionally rigid and sturdy construction of channel shapedextruded aluminum that can be easily mounted an a cab shell wall after major construction is completed or if panel replacement is desired. The advantageous channel shape of the aluminum extrusion shown in FIG. 3 provides a light weight, but still sturdy structure for the vertical and horizontal frame member. The slot 15*a* of the vertical members 19 fits over the fingers 11 of the horizontal support 3 to provide vertical support. The channel shape not only provides the desired strength and rigidity, but the channel formed in the vertical member of the lattice frame allows air to circulate behind the panels 35.

It will be obvious to those having skill in the art that many changes may be made in the above described details of the preferred embodiment of the present invention without departing from the underlying principles thereof. The scope of the present invention should, therefore, be determined only by the following claims:

We claim:

1. A structure for decorating elevator cab shell wall interiors comprising:

a lattice structure formed by a plurality of interconnected horizontal members and vertical members;

bridging means connecting said horizontal and vertical members;

a decorative surface affixed to said lattice structure;

hanger means adapted to be affixed to said elevator cab shell wall interior and engagable with said lattice structure, swing arrester means mounted on said shell wall and engagable with said lattice structure to prevent lateral movement;

said horizontal members having a channel slot for removable engagement with a claw member on said hanger means to provide vertical support;

and said vertical members being engagable with said swing arrester means to prevent lateral movement, and wherein said vertical and horizontal members are made of an aluminum extrusion with a channel shaped cross section that provides both strength and portions forming said channel slot and a surface adapted to engage said swing arrester means, and wherein said horizontal and vertical members are made of an aluminum extrusion having the same channel shape with a relatively wide flat base and with shoulders on each side extending away from said flat base a relatively short distance compared to the wide flat base.

2. The structure of claim 1 wherein one of the shoulders forms said channel slot and extends from the flat base more than twice the distance as the other shoulder and provides said channel shaped slot.

3. An apparatus for decorating elevator cab walls comprising:

at least one hanger member adapted for affixation to said elevator cab wall;

a lattice structure formed by a plurality of interconnected horizontal members and vertical members of channel shaped extrusion aluminum, said horizontal member incorporating grasping means engagable with a claw on said hanger member for removable engagement with said hanger member;

a decorative surface affixed to said lattice structure; and at least one swing arrester member affixed to said elevator cab wall and engaged with said lattice structure so as to prevent sideways motion of said lattice structure.

* * * * *